US007143512B2

(12) United States Patent
Kroetsch et al.

(10) Patent No.: US 7,143,512 B2
(45) Date of Patent: Dec. 5, 2006

(54) METHOD OF MAKING A BRAZED METAL HEAT EXCHANGER CORE WITH SELF-SHEARING REINFORCEMENT

(75) Inventors: Karl Paul Kroetsch, Williamsville, NY (US); Brian M. Hartman, Lockport, NY (US)

(73) Assignee: Delphi Technologies, Inc., Troy, MI (US)

( * ) Notice: Subject to any disclaimer, the term of this patent is extended or adjusted under 35 U.S.C. 154(b) by 482 days.

(21) Appl. No.: 10/717,166

(22) Filed: Nov. 19, 2003

(65) Prior Publication Data

US 2005/0102836 A1 May 19, 2005

(51) Int. Cl.
*B21D 53/02* (2006.01)
*B23P 15/26* (2006.01)
*B23K 35/24* (2006.01)

(52) U.S. Cl. ..... 29/890.039; 29/890.03; 29/890.043; 29/890.054; 29/418; 228/195; 228/262.51

(58) Field of Classification Search ..... 29/890.03, 29/890.054, 890.043, 890.039, 418; 165/79; 228/165, 195, 262.51, 225, 226
See application file for complete search history.

(56) References Cited

U.S. PATENT DOCUMENTS

| | | | | |
|---|---|---|---|---|
| 4,719,967 | A | 1/1988 | Scarselletta | 165/76 |
| 6,129,142 | A * | 10/2000 | Beldam | 165/81 |
| 6,328,098 | B1 | 12/2001 | Kodumudi et al. | 165/149 |
| 6,412,547 | B1 * | 7/2002 | Siler | 165/81 |
| 6,644,394 | B1 * | 11/2003 | Kraft et al. | 165/181 |

FOREIGN PATENT DOCUMENTS

JP 1-131868 A 5/1989

* cited by examiner

*Primary Examiner*—David P. Bryant
*Assistant Examiner*—Sarang Afzali
(74) *Attorney, Agent, or Firm*—Patrick M. Griffin

(57) ABSTRACT

A radiator core reinforcement self shears in the braze oven as strategically placed voids in the reinforcement erode away under the flowing action of the melted surface braze layer.

1 Claim, 3 Drawing Sheets

METHOD OF MAKING A BRAZED METAL HEAT EXCHANGER CORE WITH SELF-SHEARING REINFORCEMENT

TECHNICAL FIELD

This invention relates to brazed heat exchanger cores of the type that are subject to thermal expansion and having outer core reinforcements that require a thermal break in order to accommodate that thermal expansion.

BACKGROUND OF THE INVENTION

A typical automotive radiator core is, structurally, a basic four-sided frame, with two parallel header plates and two parallel core reinforcements joined at their ends to the ends of the header plates. Both header plates and reinforcements are typically an aluminum alloy. Spaced aluminum tubes and interleaved corrugated air fins extend perpendicular to the header plates and parallel to the core reinforcements. The core reinforcement is typically channel shaped, with a wider bottom wall and two shorter side walls. The outer surface of the bottom wall engages the corrugation peaks of the outermost fins of the cores, and the shorter walls face outwardly. The reinforcements thus act to border the outermost air fins, protecting them against damage. When all parts have been assembled and stacked, bands are tightened around the reinforcements to hold the core together, which is then run through the braze oven. A layer of braze material on the surface of the various parts, generally at least the fins, header plates and core reinforcements, melts and is pulled by capillary action into the interfaces between parts, hardening later to rigidly fuse all parts together.

In operation in the vehicle, the core reinforcements can actually become a threat to the structural integrity of the core, without further processing. This is because the tubes expand with heating, especially a coolant first begins to flow, more readily than the reinforcements, which resist the core expansion and puts stress on the tube to header joints. A simple expedient that has been implemented to solve the problem has been to saw cut through each reinforcement, through both the side walls and bottom walls, after the core has been brazed. Post braze, the core is sufficiently rigid that the core reinforcements no longer are needed for structural integrity, and will still protect the outer fins, even if cut through. Once cut, the reinforcements no longer stress the joints with thermal expansion. However, the post braze cutting operation itself is expensive and difficult to control, creating potential for the tubes just under the reinforcement to be cut or damaged.

Consequently, a number of patents have disclosed methods to improve the post braze reinforcement cutting operation. U.S. Pat. No. 4,719,967 disclosed a core reinforcement which was pre sheared through the bottom wall and part of the side walls. In one embodiment, a thin, narrow cut is made, but it is recognized that the tendency of braze material to be drawn into crevices might cause a thin cut to be filled in and "repaired" in effect, during the braze operation. A second embodiment discloses a wider pre cut, too wide to be bridged and filled in. With such a pre cut, post braze, only part of the side walls remained to be sheared, avoiding the need for a deep and potentially tube damaging saw cut all the way down through the bottom wall. There have been many variations of this basic technique proposed since then. The post braze cutting operation is not eliminated, but is made simpler and less dangerous to the outer tubes.

Another approach proposed has been to extend the basic pre cut disclosed in U.S. Pat. No. 4,719,967 so far into the core reinforcements' side walls that only a narrow web of side wall material left would remain. The webs would be strong enough to keep the reinforcement whole during banding and brazing process, but weak enough, theoretically at least, to automatically break later, during operation of the radiator core, as the core expanded and the reinforcement was stressed. It would cut itself, in effect, eliminating the cost of the sawing or shearing operation. This basic concept was disclosed at least as early as the publication of Japanese application 1-131898 in 1989. A more recent patent, U.S. Pat. No. 6,328,098, claims to assist that automatic breaking process by pre bending or scoring the webs to further weaken them. Regardless, such a scheme relies on a level of expansion during radiator operation sufficient to break the reinforcement, and to do it fairly early in the operational life of the radiator. This is difficult to predict and control, and the header plate to tube joints will inevitably experience some stress before that occurs, unlike the standard methods of completely cutting the reinforcement before the radiator goes into operation.

SUMMARY OF THE INVENTION

The invention provides a method of assuring that the radiator core reinforcement is structurally sound enough to perform during core assembly, but is completely severed before it goes into operation, without the necessity of any separate post braze step of cutting or shearing.

This is accomplished by cutting a slot out of the base wall completely at a point along it's length, at the time the reinforcement is stamped to shape, and concurrently providing a series of adjacent voids across the side walls, aligned with the ends of the base wall slot. This is easily done before the reinforcement is part of the completed core. The adjacent edges of the voids define a thin web of remaining metal which, moving vertically downwardly, converges and then diverges. During the braze process, melted braze material runs down the outer surface of the side wall, and is guided by the adjacent edges of adjacent voids continually across the webs, without restriction, by virtue of the converging, diverging shape. The webs are thin enough such that, while not directly melted through, they are softened and, under the action of the continual stream of running, melted braze material, are eroded away and severed during the duration of the braze process. This, in conjunction with the base wall slot, completely severs the reinforcement at that point, with no need for a post braze shearing step, and with no need for a later fatigue fracture during radiator operation.

DESCRIPTION OF THE PREFERRED EMBODIMENT

Figures 1, 1A:
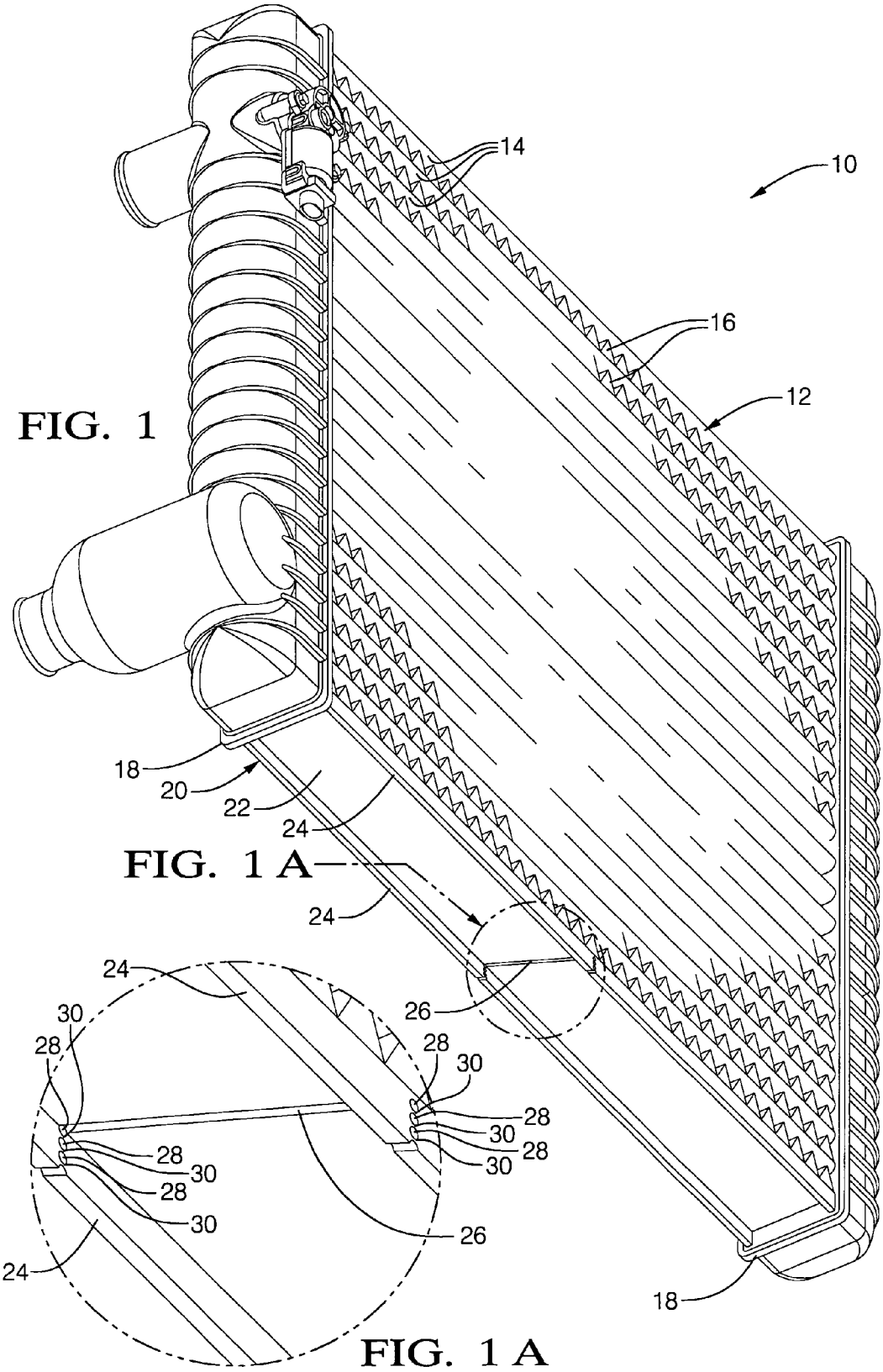
FIG. 1 is a perspective view of a radiator with a core reinforcement according to the invention, after brazing.

Referring first to FIG. 1, an assembled radiator 10 has a brazed core 12, which consists of aluminum tubes 14, intervening fins 16, and header plates 18, and core reinforcements, indicated generally at 20. The header plates 18 and reinforcements 20 form a four-sided frame around the stacked tubes 14 and fins 16. The reinforcements 20 protect the outermost fins 16, both after braze and during the braze process, when the core components are clamped or banded together. Each reinforcement 20 is an elongated (approximately 800 mm long), channel shaped member with a wider base wall 22 (approximately 24 mm) and shorter side walls 24 (approximately 16 mm), stamped from an aluminum alloy, such as the alloy commonly known as 3003. The material thickness is approximately 1.5 mm, of which about 2 to 6 percent is comprised of a surface layer of braze material, such as the aluminum-silicon eutectic alloy known as 4045. The braze layer has a melt temperature lower than the base aluminum alloy, and is hot rolled, or plasma sprayed, or otherwise applied onto the base metal as it is formed. While it is necessary to maintain the structural integrity of the reinforcement 20 during the core assembly and brazing process, it is actually desirable to sever it later, at some point along its length, as noted above. Doing so allows the reinforcements 20 to still shield and protect the outermost fins 16, but with all elements of the core rigidly brazed together at their various interfaces, the reinforcements 20 no longer need serve as structurally integral sides of a four sided frame, as they did during the banding and brazing process. Cutting or severing the reinforcements 20 post braze is actually useful, as noted, in preventing the core stresses during later operation that could threaten tube to header joints. The method of the invention allows for that severing with no post braze manufacturing steps or occurrences.

Figure 2:
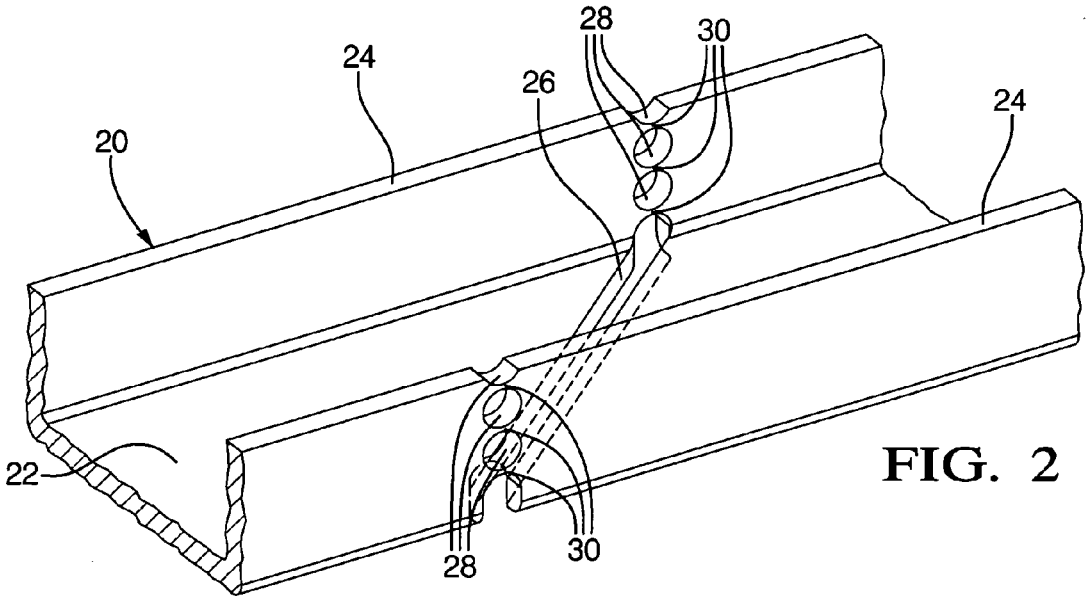
FIG. 2 is a perspective view of a portion of a core reinforcement showing the self-shearing features prior to brazing.
Figure 3:
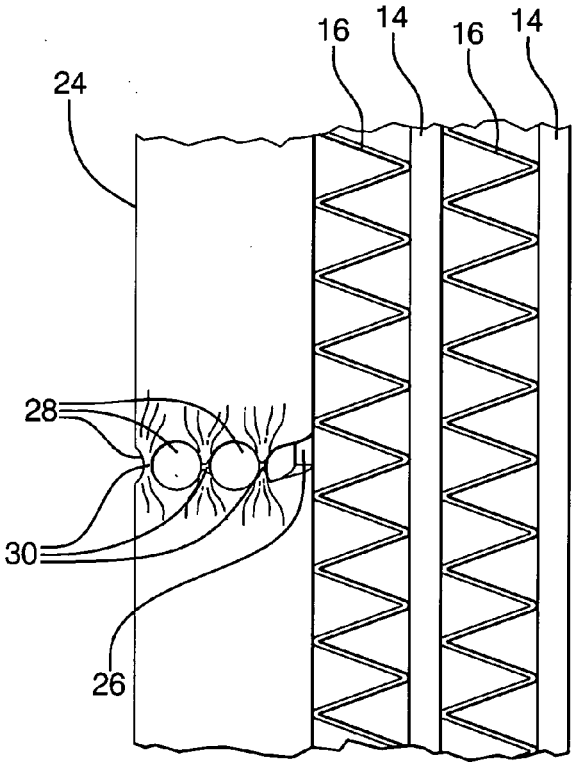
FIG. 3 is a side view of the self-shearing feature of FIG. 2, as it is going through the braze process.

Referring next to FIGS. 2 and 3, during the stamping and folding of reinforcement 20, it is provided with a set of cooperative slots and voids, as by punching or lancing, which act to self sever the part during the brazed process. Specifically, an angled slot 26 is cut across the base wall 22 about, at about a 45 degree angle with a width of approximately 3 mm, and running past the base wall/side wall juncture and slightly into each side wall 24. Each end of slot 26 is radiused at about two mm. The slot 26 is easily provided at the time of initial manufacture, as opposed to a post core braze saw cut, which entails manipulating a heavy part, and jeopardizing the core by a too deep cut. Concurrently, a series of adjacent round holes 28 are punched through the side walls 24 in an area that will align them with the ends of the slot 26, when reinforcement 20 is fully folded. In the embodiment disclosed, the holes 28 have a diameter of approximately 4.6 mm, and there is sufficient width left in the side wall 24 to accommodate two complete holes, plus a partial hole 28 near the edge. The number of holes (and/or partial holes) is not significant per se, but is chosen so as to leave hourglass shaped, intervening webs 30 between as the sole remaining structure across the side walls 24. These webs 30 have a narrowest, waist width of 0.6 to 0.8 mm, as disclosed. In general, what is significant is that the webs 30 have sufficient width and strength to maintain the structural integrity of the side walls 24 (and therefore of the entire reinforcement 20) during core assembly and most of the braze process, but no more than that. It is also significant that the adjacent edges of the circular holes 28 (or of adjacent voids of other possible shape) define webs between that are shaped so as to converge smoothly to a narrowest point and then diverge, as seen moving in the length direction of the side wall 24. The reason for this shape and orientation is described below.

Figure 4:
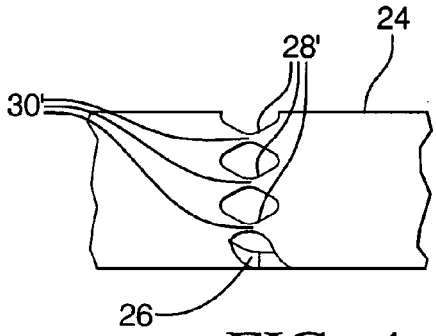
FIG. 4 is a side view of one alternate embodiment of the self-shearing feature.
Figure 5:
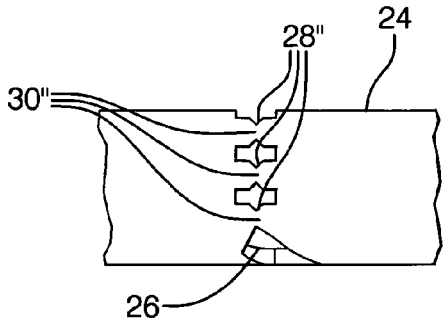
FIG. 5 is a side view of another alternate embodiment.

Referring next to FIGS. 4 and 5 other shapes for the holes or voids 28 could be provided, to work in conjunction with the same slot 26. These are given the same numbers primed and double primed respectively. In FIG. 4, the holes 28' are elliptical, with their long axes parallel to the length of reinforcement 20, leaving webs 30' that are also hour glass in shaped, but more elongated than the webs 30. In FIG. 5, the holes 28" are rectangular, but with v shaped notches at the center to create necked down webs 30" between. All embodiments leave the same narrow webs of similar width formed by the adjacent voids, converging and then diverging, moving along the axial length direction of the reinforcement 20. As such, all embodiments achieve the same basic end result, as described next.

Figure 6:
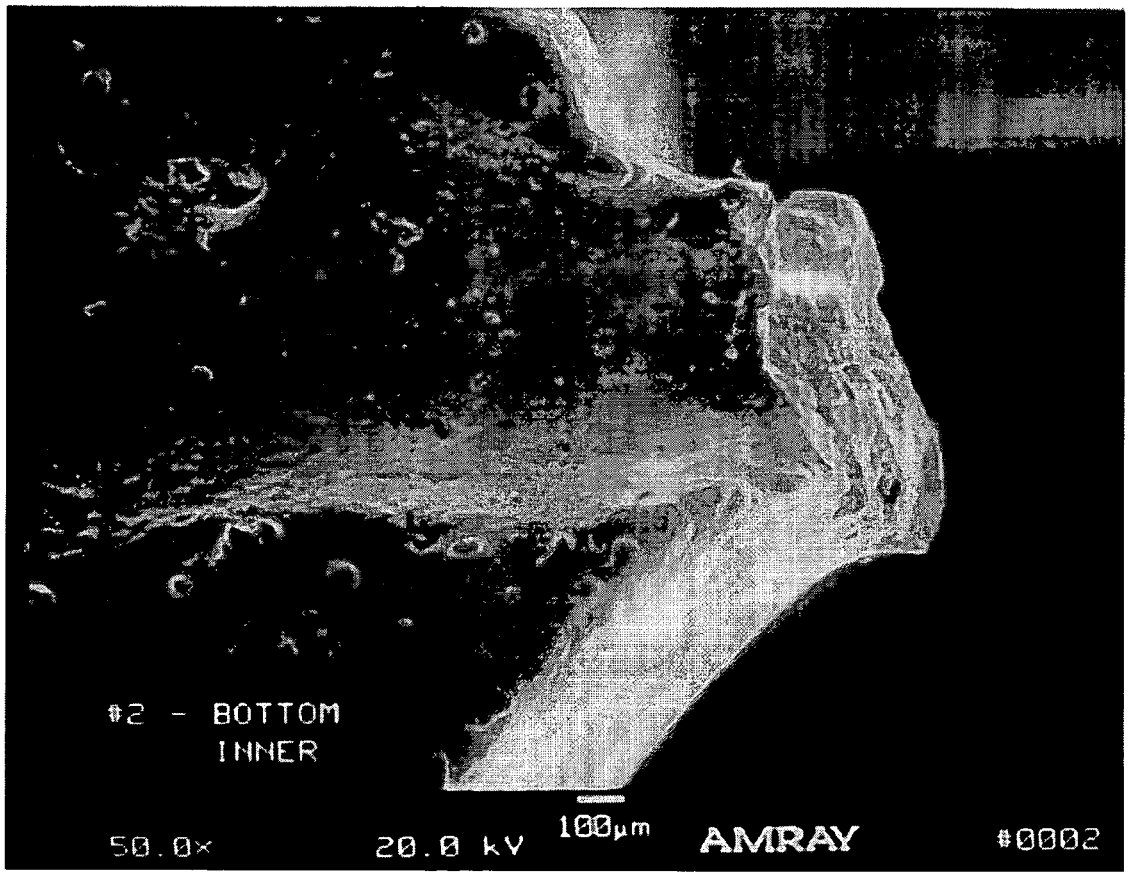
FIG. 6 is a photo micrograph of an eroded and self sheared web post brazing.

Referring next to FIGS. 3 and 6, the core 12 referred to above is oriented in the braze oven in a with the reinforcement 20 in a vertical direction, as shown. Bands or clamps, not shown but well known in the art, would be fixed around the reinforcements 20, holding the tubes 14 and fins 16 together temporarily. The core 12 is brought to the predetermined braze temperature of approximately 1100 degrees F., hot enough to thoroughly melt the braze alloy layer of eutectic aluminum-silicon, but not to melt the aluminum alloy of the base components, and kept there for several minutes. During this process, the melted braze material runs vertically downwardly, skirting the edges of the voids 28 by virtue of surface tension effects, and guided continually across the webs 30. While the webs 30, being of the same base alloy as the rest of the wall 24, will not melt as such, they are relatively thin, enough so that the river of melted braze material running over them is able to erode and sever them. This severs both side walls 24. Two factors are at work. The webs 30 are not only thinned, but the shape and in-oven orientation directs more melted braze material over their surface. That melted braze material diffuses into the base alloy material in a process called dissolution, but generally referred to here as erosion. The end effect is best seen in the photo micrograph of FIG. 6, showing a severed web 30 at about fifty times size. The net result is that, in conjunction with the pre existing slot 26, the entire reinforcement 20 is physically severed. At that point in the braze process, though the braze joints are not hardened to complete core 12, since it is still after the stacking and clamping operations, the reinforcement 20 need not be physically integral. And, of course, after final cooling and completion of the core 12, no further severing or cutting operation, with the attendant expense and threat to tube integrity, will be necessary.

The exact same action can occur with the other embodiments disclosed in FIGS. 4 and 5, since they have the same basic void shape and orientation during braze. Other base alloys and braze materials could theoretically be used, so long as they had the same relative melting relationship. In the event that reinforcement member 20 did not have the typical channel shape, with base and side walls, it would be possible to provide just a series of webs and voids sufficient to extend completely across a surface of the member. The channel shape is typical, however, as it is strong and relatively easy to form. More than one set of slots and webs could be used, if desired, to create more than one point of severance, which would be almost as easy to provide in the reinforcement ahead of time as would one. Additional post braze saw cuts, of course, would each entail equal additional expense.

The invention claimed is:

1. A method of making a brazed metal heat exchanger core having an elongated structural member the structural unity of which it is desired to maintain prior to a braze process, but which it is desired to later sever, and in which said elongated member is assembled with said core and also has a predefined surface area thereof oriented substantially vertically during the braze process at a predetermined braze temperature and duration, said elongated member being formed from a base alloy with a melting temperature above said predetermined braze temperature and is clad with a braze material that melts and flows at a temperature below said predetermined braze temperature, said method comprising the steps of, providing a series of adjacent voids through said predefined surface area prior to assembling said core across the width of said elongated structural member, with webs between said voids having just sufficient width and strength to maintain the structural integrity of said elongated member during core assembly, with adjacent edges of said voids defining said webs being shaped such that said webs converge smoothly to a narrowest point and then diverge, moving vertically downwardly when said predefined surface area is oriented substantially vertically, assembling said core, orienting said core with said predefined surface substantially vertical, brazing said core at said predetermined temperature and duration, during which melted braze material runs vertically downwardly, guided by said void edges and continually across said webs, said webs being sufficiently thin such that, during the braze process, running braze material erodes and severs said webs and thereby severs said elongated member completely.

* * * * *